US010208751B2

(12) United States Patent
Kawamura et al.

(10) Patent No.: US 10,208,751 B2
(45) Date of Patent: Feb. 19, 2019

(54) SCROLL COMPRESSOR HAVING INJECTION PORTS PROVIDED IN OUTER CIRCUMFERENTIAL SURFACE BETWEEN OPENING ENDS OF COMMUNICATION PATHS AND INLET PORTS FOR INJECTING LIQUID REFRIGERANT IN DIRECTION TOWARD THE INLET PORTS

(71) Applicant: Mitsubishi Electric Corporation, Chiyoda-ku (JP)

(72) Inventors: Raito Kawamura, Chiyoda-ku (JP); Shin Sekiya, Chiyoda-ku (JP); Shinichi Wakamoto, Chiyoda-ku (JP); Masayuki Kakuda, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 69 days.

(21) Appl. No.: 15/522,150

(22) PCT Filed: Nov. 20, 2014

(86) PCT No.: PCT/JP2014/080807
§ 371 (c)(1),
(2) Date: Apr. 26, 2017

(87) PCT Pub. No.: WO2016/079858
PCT Pub. Date: May 26, 2016

(65) Prior Publication Data
US 2017/0335847 A1 Nov. 23, 2017

(51) Int. Cl.
*F03C 2/00* (2006.01)
*F03C 4/00* (2006.01)
(Continued)

(52) U.S. Cl.
CPC ..... *F04C 18/0292* (2013.01); *F04C 18/0215* (2013.01); *F04C 23/008* (2013.01);
(Continued)

(58) Field of Classification Search
CPC ..... F04C 18/0215; F04C 18/0292; F04C 23/008; F04C 29/0085; F04C 29/028;
(Continued)

(56) References Cited

U.S. PATENT DOCUMENTS

2005/0217292 A1 10/2005 Onishi et al.
2010/0212352 A1* 8/2010 Kim ..... F04C 18/0215 418/55.2

(Continued)

FOREIGN PATENT DOCUMENTS

JP 05-248370 A * 9/1993 ..... F04C 18/0215
JP 11-230075 A 8/1999

(Continued)

OTHER PUBLICATIONS

International Search Report dated Feb. 10, 2015, in PCT/JP2014/080807, filed Nov. 20, 2014.

(Continued)

*Primary Examiner* — Theresa Trieu
(74) *Attorney, Agent, or Firm* — Oblon, McClelland, Maier & Neustadt, L.L.P.

(57) ABSTRACT

A second space communicated with a first space through communicating paths is provided on an outer circumferential side of first and second scroll bodies. Scroll end portions of the first and second scroll bodies form an inlet port configured to suck gas refrigerant into a compression chamber from the second space. Open ends of the communicating paths on a side of the second space are located at an angle larger than 0° and less than or equal to 180°, around a central axis of a rotating shaft portion, from the inlet ports in a scroll
(Continued)

involute direction of the first scroll body and the second scroll body, respectively. Injection ports in a part of an outer circumference of the second space between the open ends and the inlet ports in a circumferential direction are configured to eject liquid refrigerant in a direction toward the inlet ports, respectively.

6 Claims, 9 Drawing Sheets

(51) Int. Cl.

| | |
|---|---|
| ***F04C 18/00*** | (2006.01) |
| ***F04C 18/02*** | (2006.01) |
| ***F04C 23/00*** | (2006.01) |
| ***F04C 29/02*** | (2006.01) |
| ***F04C 29/12*** | (2006.01) |
| *F04C 29/00* | (2006.01) |

(52) U.S. Cl.
CPC ..... *F04C 29/028* (2013.01); *F04C 29/12* (2013.01); *F04C 29/0085* (2013.01); *F04C 2210/26* (2013.01); *F04C 2240/30* (2013.01); *F04C 2240/40* (2013.01)

(58) Field of Classification Search
CPC .. F04C 29/12; F04C 2210/26; F04C 2240/30; F04C 2240/40
USPC ..... 418/55.1–55.6, 57, 88, 94, 102
See application file for complete search history.

(56) References Cited

U.S. PATENT DOCUMENTS

| | | | | |
|---|---|---|---|---|
| 2012/0258004 | A1* | 10/2012 | Ignatiev | F04C 18/0215 418/55.2 |
| 2015/0004040 | A1* | 1/2015 | Katou | F04C 18/0215 418/55.2 |
| 2016/0230765 | A1* | 8/2016 | Watanabe | F04C 18/0215 418/55.3 |

FOREIGN PATENT DOCUMENTS

| | | | |
|---|---|---|---|
| JP | 2000-54972 | A | 2/2000 |
| JP | 2005-282972 | A | 10/2005 |
| JP | 2008-138921 | A | 6/2008 |

OTHER PUBLICATIONS

Office Action dated Oct. 17, 2017 in Japanese Patent Application No. 2016-559765 (with English language translation).

* cited by examiner

SCROLL COMPRESSOR HAVING INJECTION PORTS PROVIDED IN OUTER CIRCUMFERENTIAL SURFACE BETWEEN OPENING ENDS OF COMMUNICATION PATHS AND INLET PORTS FOR INJECTING LIQUID REFRIGERANT IN DIRECTION TOWARD THE INLET PORTS

TECHNICAL FIELD

The present invention relates to a scroll compressor.

BACKGROUND ART

An air-conditioning apparatus such as a building multi-air-conditioning apparatus has a configuration in which an outdoor unit (heat source unit) placed, for example, outside a building and an indoor unit placed in the building are connected through a refrigerant pipe. By causing refrigerant circulating in a refrigerant circuit to transfer or receive heat to or from air, the air-conditioning apparatus heats or cools an air-conditioned space. At a compressor of the air-conditioning apparatus, when a discharge temperature increases, a temperature of a refrigerating machine oil or sealant may exceed a guaranteed temperature. To solve this problem, a measure is necessary to decrease the discharge temperature of the compressor.

An air-conditioning apparatus equipped with an injection circuit is described in Patent Literature 1. The injection circuit of the air-conditioning apparatus has a configuration in which a bypassing expansion device, the refrigerant heat exchanger, a first on-off valve, and a compressor injection port are connected in sequence via an injection pipe branching off from a refrigerant pipe of a main circuit at a point between a refrigerant heat exchanger and a load side expansion device. In the compressor, the refrigerant sucked through the main circuit is compressed to an intermediate-pressure refrigerant, and is then merged with refrigerant injected from the injection circuit. The merged refrigerant is compressed to a high-pressure refrigerant and then is discharged.

Also, a scroll compressor equipped with an injection pipe is described in Patent Literature 2. In the scroll compressor, an outer end of a fixed scroll lap and an outer end of a movable scroll lap are installed close to each other. An intake port configured to introduce refrigerant gas to a compression chamber is formed on each of an external surface side and an internal surface side of the outer end of the movable scroll lap. A pocket is formed in the vicinity of the intake ports by a partition portion. An injection pipe is laid under the pocket to release oil or liquid refrigerant to the pocket.

CITATION LIST

Patent Literature

Patent Literature 1: Japanese Unexamined Patent Application Publication No. 2008-138921

Patent Literature 2: Japanese Unexamined Patent Application Publication No. 2000-054972

SUMMARY OF INVENTION

Technical Problem

However, with the configuration described in Patent Literature 1, refrigerant is injected into an intermediate pressure portion of the compressor. Consequently, parts of refrigerants differing in pressure are mixed, causing a mixing loss, and thereby degrading performance of the compressor.

Also, with the configuration described in Patent Literature 2, during an orbital period of the movable scroll, in a rotation phase in which the intake ports are closed or in a rotation phase in which flow paths of the intake ports are narrowed, the injected liquid refrigerant may bounce of an end of a scroll body and flow back to a bottom of a container where a refrigerating machine oil is stored. In this case, the refrigerating machine oil is diluted by the liquid refrigerant and thus viscosity of the refrigerating machine oil supplied to sliding parts such as bearings is reduced, thereby degrading reliability of the compressor.

The present invention has been made to solve at least one of the above problems and has an object to provide a scroll compressor having improved reliability and performance as well as a decreased discharge temperature.

Solution to Problem

A scroll compressor according to an embodiment of the present invention includes a sealed container, a motor element housed in the sealed container, a scroll compression element housed in the sealed container and configured to be driven by a rotating shaft portion of the motor element, and a frame placed between the motor element and the scroll compression element in the sealed container and configured to support the scroll compression element. The scroll compression element includes a fixed scroll fixed to the frame and including a first scroll body and an orbiting scroll including a second scroll body configured to be engaged with the first scroll body to form a compression chamber between the first scroll body and the second scroll body and orbit opposed to the fixed scroll. A first space into which gas refrigerant sucked from outside flows is provided in the sealed container on a motor element side of the frame. A second space communicated with the first space through a communicating path is provided on an outer circumferential side of the first scroll body and the second scroll body. A scroll end portion of the first scroll body and a scroll end portion of the second scroll body are each configured to form an inlet port configured to suck the gas refrigerant into the compression chamber from the second space. An open end of the communicating path on a side of the second space is located at an angle larger than 0 degrees and less than or equal to 180 degrees, around a central axis of the rotating shaft portion, from the inlet port in a scroll involute direction of the first scroll body and the second scroll body. An injection port is provided in a part of an outer circumference of the second space between the open end and the inlet port in a circumferential direction and configured to eject liquid refrigerant in a direction toward the inlet port.

Advantageous Effects of Invention

According to the embodiment of the present invention, the liquid refrigerant ejected from the injection port flowing back to the first space is reduced, and thus the refrigerating machine oil can be prevented from being diluted by the liquid refrigerant. Thus, reliability of the scroll compressor can be improved while a discharge temperature can be decreased. Also, according to the embodiment of the present invention, the refrigerant in the second space is rectified to flow in a single direction, and thus fluid loss in the second space can be reduced. Consequently, performance of the scroll compressor can be improved.

DESCRIPTION OF EMBODIMENTS

Embodiment 1

Figure 1:
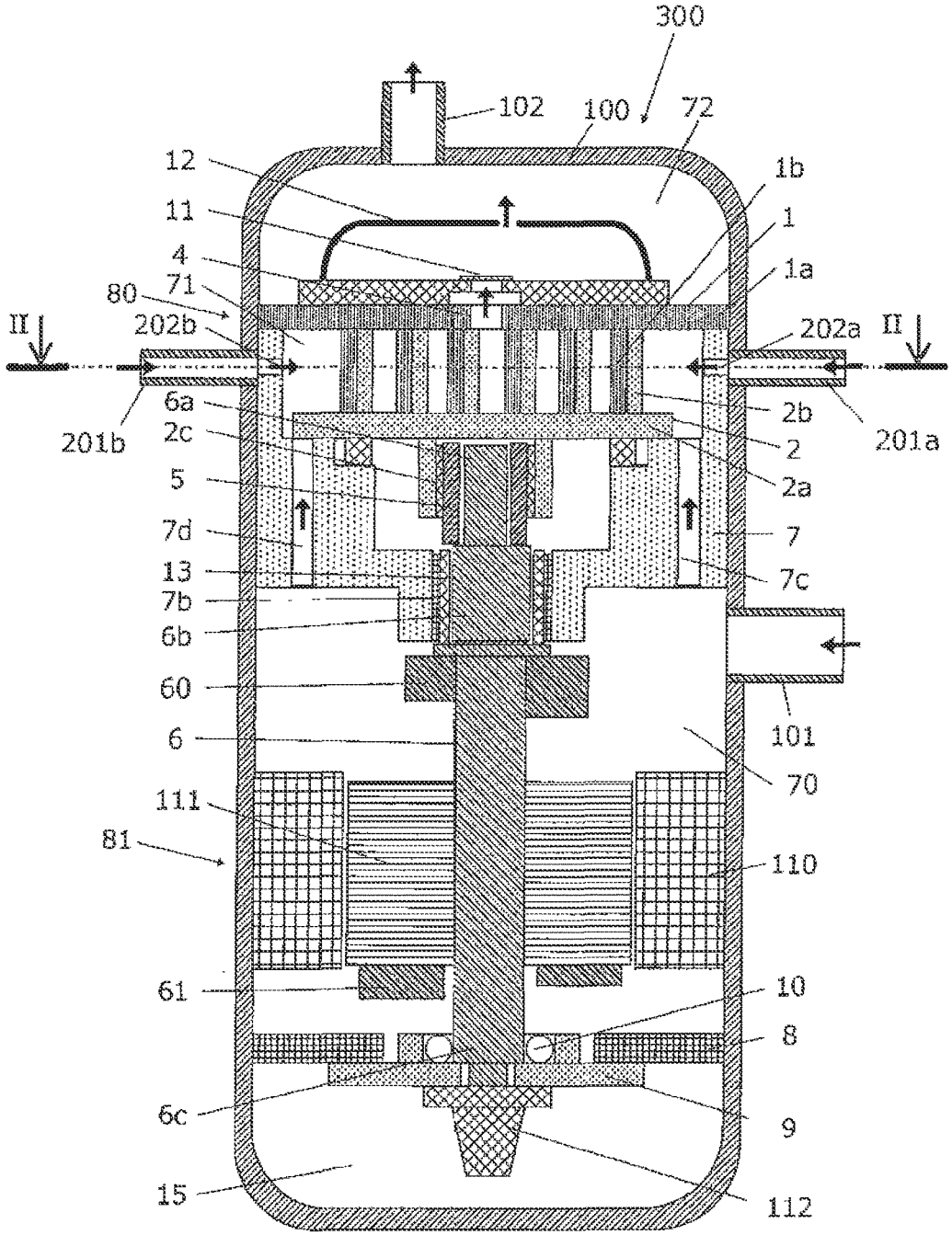
FIG. 1 is a longitudinal section view illustrating a schematic configuration of a scroll compressor 300 according to Embodiment 1 of the present invention.

A scroll compressor according to Embodiment 1 of the present invention will be described. FIG. 1 is a longitudinal section view illustrating a schematic configuration of a scroll compressor 300 according to the present embodiment. The scroll compressor 300 is a fluid machine configured to compress and discharge a fluid (e.g., gas refrigerant), and can be a component of a refrigeration cycle apparatus used, for example, in a refrigerator, freezer, automatic vending machine, air-conditioning apparatus, refrigeration unit, and water heater. The scroll compressor 300 according to the present embodiment is a vertically-mounted, low-pressure shell compressor. In FIG. 1, flow of the fluid is indicated by arrows. Note that, in the following drawings including FIG. 1, components may not be shown in their true size relations or shapes.

As shown in FIG. 1, the scroll compressor 300 has a configuration in which a scroll compression element 80 configured to compress a fluid and a motor element 81 configured to drive the scroll compression element 80 are housed in a sealed container 100. The scroll compression element 80 is supported by a frame 7. The frame 7 is fixed to an inner circumferential surface of the sealed container 100 through shrink fit or other method. The frame 7 is placed between the scroll compression element 80 and the motor element 81 in the sealed container 100. A subframe 9 is provided below the motor element 81. The subframe 9 is fixed to the inner circumferential surface of the sealed container 100 via a subframe plate 8. An oil sump 15 is formed on a bottom of the sealed container 100. A refrigerating machine oil lubricating sliding parts such as bearings is accumulated in the oil sump 15.

A first space 70 (suction space) into which a fluid (low-pressure gas refrigerant, in this example) sucked from outside flows is provided below the frame 7 (i.e., on the side of the motor element 81) in the sealed container 100. A suction pipe 101 configured to suck a fluid into the first space 70 from outside is connected to a side face of the sealed container 100. Also, a side face of the sealed container 100 above the suction pipe 101 is connected with injection pipes 201*a* and 201*b* configured to inject a fluid (low-pressure liquid refrigerant or two-phase refrigerant including liquid refrigerant, in this example) introduced from outside into a second space 71 described later (details will be described later).

The scroll compression element 80 includes a fixed scroll 1 and an orbiting scroll 2 placed below the fixed scroll 1. The fixed scroll 1 is fixed to an upper end portion of the frame 7 and blocks a tubular opening of the frame 7. The fixed scroll 1 includes a base plate 1*a* and a first scroll body 1*b* having an involute curve shape and erected on one surface (undersurface, in this example) of the base plate 1*a*. A discharge port 4 configured to discharge a compressed fluid is formed in a central part of the fixed scroll 1. A discharge valve 11 having a reed valve structure is installed on an outlet side of the discharge port 4. The fluid discharged through the discharge valve 11 passes through a space in a discharge muffler 12 to flow into a third space 72 (discharge space) located above the scroll compression element 80. A discharge pipe 102 configured to discharge the fluid out of the third space 72 is connected to a top face of the sealed container 100.

The orbiting scroll 2 is housed in a tubular space in the frame 7. The orbiting scroll 2 is configured to orbit opposed to the fixed scroll 1 without rotating, by a non-illustrated Oldham mechanism. The orbiting scroll 2 includes a base plate 2*a* and a second scroll body 2*b* having an involute curve shape and erected on one surface (top face, in this example) of the base plate 2*a*. Another face of the base plate 2*a* is configured to be supported in an axial direction by a thrust surface formed on the frame 7. Also, an orbiting bearing 2*c* having a bottomed cylindrical shape is formed in a substantially central part on the other face of the base plate 2*a*. A slider 5 configured to support the orbiting scroll 2 is rotatably contained in the orbiting bearing 2*c* to cause the orbiting scroll 2 to orbit. An eccentric shaft portion 6*a* installed on an upper end of a rotating shaft portion 6 described later is inserted in the slider 5.

The motor element 81 includes an electric motor stator 110 fixed to the inner circumferential surface of the sealed container 100 through shrink fit or other method, an electric motor rotor 111 rotatably housed on an inner circumferential side of the electric motor stator 110, and a rotating shaft portion 6 (main shaft) fixed to the electric motor rotor 111 through shrink fit or other method. The electric motor stator 110 is connected to a glass terminal (not shown) provided between the frame 7 and the electric motor stator 110 via lead wires. The electric motor stator 110 is supplied with electric power from outside via the glass terminal and lead wires. The electric motor rotor 111 is configured to rotate as electric power is supplied to the electric motor stator 110 and transmit a driving force to the orbiting scroll 2 through the rotating shaft portion 6.

A main shaft portion 6*b* located above the electric motor rotor 111 in the rotating shaft portion 6 is rotatably supported in a radial direction by a main bearing 7*b* installed on the frame 7. The main bearing 7*b* is formed by fixing, through press fitting or other method, a bearing material such as a copper lead alloy used for a sliding bearing, in an inner circumference of a boss portion installed on the frame 7. The main shaft portion 6*b* is fitted in the main bearing 7*b*, and a sleeve 13 is interposed between the main shaft portion 6*b* and the main bearing 7*b*. The main shaft portion 6*b* slides along the main bearing 7*b* and an oil film of a lubricating oil. The eccentric shaft portion 6*a* eccentric to the main shaft portion 6*b* is installed on the upper end of the rotating shaft portion 6.

A countershaft portion 6*c* located below the electric motor rotor 111 in the rotating shaft portion 6 is rotatably supported in the radial direction by a secondary bearing 10 installed on the subframe 9. The secondary bearing 10 of this example includes a ball bearing, but may have another bearing configuration. The countershaft portion 6*c* is fitted in the secondary bearing 10, and slides along the secondary bearing 10, and an oil film of a lubricating oil is interposed between the countershaft portion 6*c* and the secondary bearing 10.

An axis of the main shaft portion 6*b* and an axis of the countershaft portion 6*c* are the same as an axis of the rotating shaft portion 6. To balance an entire rotation system of the scroll compressor 300, a first balance weight 60 is mounted on an upper portion of the rotating shaft portion 6 and a second balance weight 61 is mounted on a lower portion of the electric motor rotor 111. A pump element 112 such as a positive displacement pump is installed at a lower end of the rotating shaft portion 6. The pump element 112 supplies the refrigerating machine oil accumulated in the oil sump 15 to the sliding parts such as the main bearing 7*b*. The pump element 112 is mounted on the subframe 9 and supports the rotating shaft portion 6 in the axial direction on an upper end surface of the pump element 112.

Figure 2:
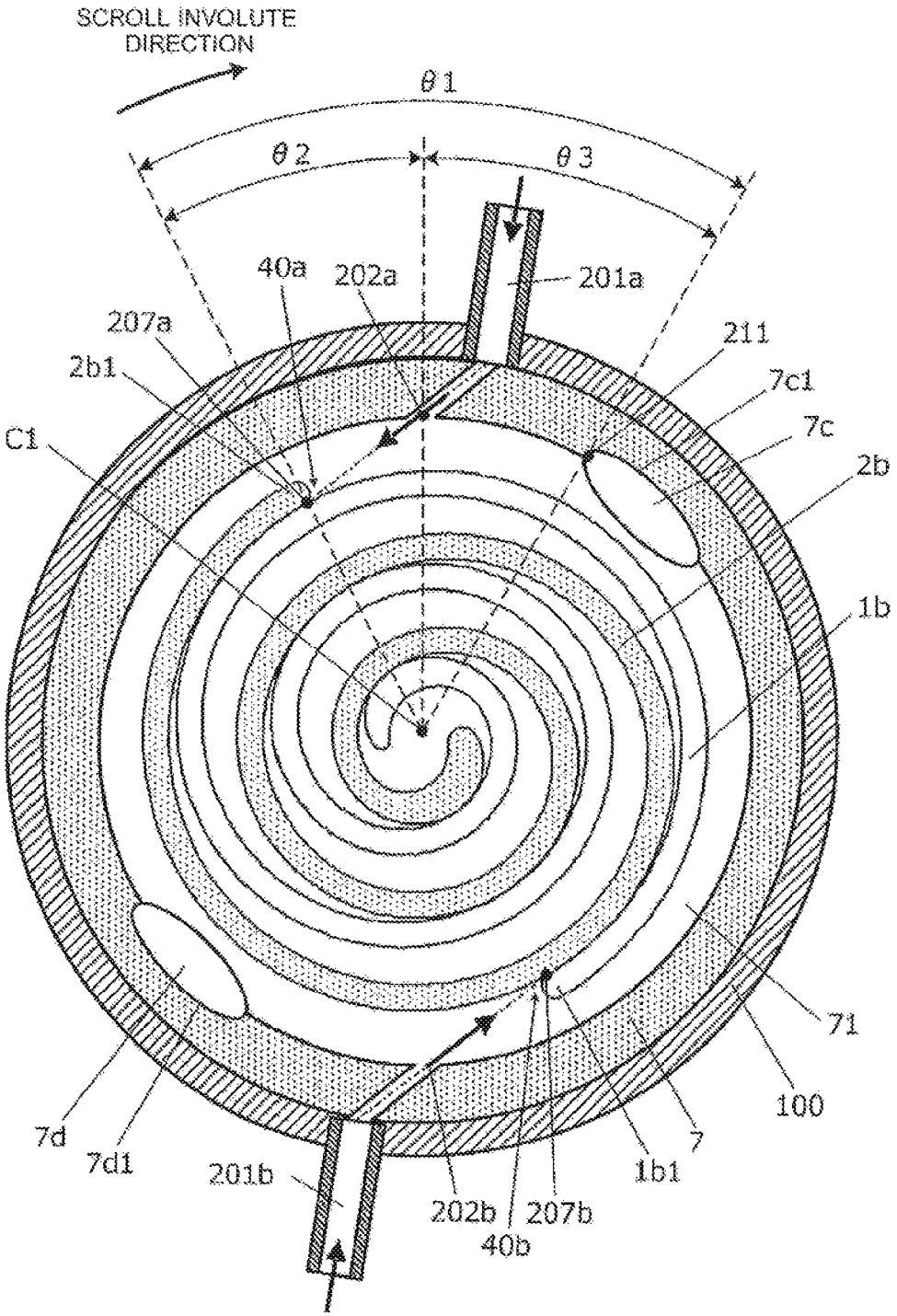
FIG. 2 is a sectional view taken along line II-II in FIG. 1.

FIG. 2 is a sectional view taken along line II-II in FIG. 1. In FIG. 2, flow of an injected fluid is indicated by arrows. As shown in FIG. 2, the first scroll body 1*b* of the fixed scroll 1 and the second scroll body 2*b* of the orbiting scroll 2 are engaged with each other in opposite phases to each other (phase difference of 180 degrees). Scroll involute directions of both the first scroll body 1*b* and the second scroll body 2*b* correspond to a clockwise direction in FIG. 2. A compression chamber configured to compress the fluid is formed between the first scroll body 1*b* and the second scroll body 2*b*.

The second space 71 having an annular shape is formed on an outer circumferential side of the first scroll body 1*b* and the second scroll body 2*b* and on an inner circumferential side of an inner wall surface of the frame 7. The second space 71 is communicated with the first space 70 through communicating paths 7*c* and 7*d* formed to penetrate the frame 7 in a vertical direction. Positions of open ends 7*c*1 and 7*d*1 of the communicating paths 7*c* and 7*d* on the side of the second space 71 will be described later.

A scroll end portion 2*b*1 of the second scroll body 2*b* forms an inlet port 40*a* between an outer circumferential surface of the adjacent first scroll body 1*b* and the scroll end portion 2*b*1. A scroll end portion 1*b*1 of the first scroll body 1*b* forms an inlet port 40*b* between an outer circumferential surface of the adjacent second scroll body 2*b* and the scroll end portion 1*b*1. The inlet ports 40*a* and 40*b* suck the fluid from the second space 71 into the compression chamber formed between the first scroll body 1*b* and the second scroll body 2*b*. FIG. 2 shows a rotation phase (0 degrees) at a time point at which suction of the fluid into the compression chamber is completed (i.e., a time point at which next suction is started), and thus both the inlet ports 40*a* and 40*b* are closed. In a state shown in FIG. 2, a point of the second scroll body 2*b* located closest to the scroll end portion 2*b*1 is in contact with a contact point 207*a* of the first scroll body 1*b* and a contact point 207*b* of the first scroll body 1*b* located closest to the scroll end portion 1*b*1 is in contact with the second scroll body 2*b*. The contact point 207*a* and the contact point 207*b* are placed to face each other across a central axis C1 of the rotating shaft portion 6.

The injection pipe 201*a* penetrates the sealed container 100 to connect the injection port 202*a*. The injection port 202*a* is formed to penetrate a tubular wall of the frame 7 and communicates the injection pipe 201*a* with the second space 71. The injection pipe 201*b* penetrates the sealed container 100 to connect the injection port 202*b*. The injection port 202*b* is formed to penetrate the tubular wall of the frame 7 and communicates the injection pipe 201*b* with the second space 71. The Injection ports 202*a* and 202*b* eject the fluid (liquid refrigerant or two-phase refrigerant including liquid refrigerant, in this example) supplied from outside through the injection pipes 201*a* and 201*b* into the second space 71 from the side of the outer circumference of the second space 71.

Next, a description will be given of positional relationships among the open ends 7*c*1 and 7*d*1 of the communicating paths 7*c* and 7*d*, the inlet ports 40*a* and 40*b*, and the injection ports 202*a* and 202*b* as well as orientations of the injection ports 202*a* and 202*b*. In the configuration of this example, a set of the open end 7*c*1, the inlet port 40*a*, and the injection port 202*a* and a set of the open end 7*d*1, the inlet port 40*b*, and the injection port 202*b* are placed to face each other across the central axis C1 (e.g., positions point-symmetrical to the central axis C1). Thus, although the set of the open end 7*c*1, the inlet port 40*a*, and the injection port 202*a* is taken as an example in the following description, the description similarly applies to the set of the open end 7*d*1, the inlet port 40*b*, and the injection port 202*b*. A position of the open end 7*c*1 is identified by a position of an end portion 211 of the open end 7*c*1 located closest to the inlet port 408. A position of the inlet port 40*a* is identified, for example, by a position of the contact point 207*a*. A position of the injection port 202*a* is identified, for example, by a position of a downstream end of the injection port 202*a*, which is the outer circumference of the second space 71. Also, in the following description, positional relationships among the open end 7*c*1, the inlet port 40*a*, and the injection port 202*a* as well as an orientation of the injection port 202*a* are viewed in a direction parallel to the central axis C1 as shown in FIG. 2.

The open end 7*c*1 is placed at a position at which an angle θ1 from the inlet port 40*a* is larger than 0 degrees and less than or equal to 180 degrees (0 degrees<θ1≤180 degrees) in the scroll involute direction around the central axis C1 (i.e., a center of a base circle of a curve forming the first scroll body 1*b*). The inlet port 40*a* is the closest inlet port to the open end 7*c*1 in a counter-helical involute direction (counterclockwise direction). That is, the open end 7*c*1 is located at a position displaced from the inlet port 40*a* around the central axis C1. An outer circumferential flow path is formed in the second space 71 between the open end 7*c*1 and the inlet port 40*a* to allow gas refrigerant to flow along an outer circumference of the first scroll body 1*b* (or the second scroll body 2*b*) from the open end. 7*c*1 to the inlet port 40*a*. Consequently, the gas refrigerant entering the second space 71 through the open end 71 passes through the outer circumferential flow path and then enters the inlet port 40*a*, instead of directly entering the inlet port 40*a*. Note that, when the angle θ1 between the inlet port 40*a* and the open end 7c1 fluctuates to some extent because the orbiting scroll 2 orbits opposed to the fixed scroll 1, the angle 81 at which the inlet port 40a and the open end 7c1 come closest to each other is set larger than 0 degrees. Also, although the displacement angle θ1 is described to be larger than 0 degrees, the angle θ1 is more preferably set, for example, larger than 30 degrees to suitably increase the length of the outer circumferential flow path to the inlet port 40a. Also, although the angle θ1 is described to be less than or equal to 180 degrees, desirably the angle θ1 is less than or equal to 180 degrees at a position at which the inlet port 40a and the open end 7c1 are most distant from each other. Desirably the outer circumferential flow path from the inlet port 40a to the open end 7c1 in the scroll involute direction is shorter than an outer circumferential flow path from the inlet port 40a to the open end 7c1 in an opposite direction. Consequently, the angle 81 is preferably less than 180 degrees, for example, less than or equal to 120 degrees. The angle θ1 is preferably less than or equal to 90 degrees, at which the outer circumferential flow path from the open end 7c1 to the inlet port 40a is shorter than the opposite flow path from the open end 7c1 to the inlet port 40b.

The injection port 202a is provided in a part of the outer circumference of the second space 71 between the open end 7c1 and the inlet port 40a in the circumferential direction. That is, an angle θ2 formed between the inlet port 40a and the injection port 202a around the central axis C1 is smaller than the angle θ1 (0 degrees<θ2<θ1). Also, the angle θ2 formed between the inlet port 40a and the injection port 202a around the central axis C1 is smaller than an angle θ3 formed between the injection port 202a and the open end 7c1 around the central axis C1 (θ2<θ3). That is, a distance between the inlet port 40a and the injection port 202a is shorter than a distance between the injection port 202a and the open end 7c1.

Also, the injection port 202a of this example is bored to extend along a tangent at the contact point 207a. Consequently, the injection port 202a is configured to eject liquid refrigerant toward the inlet port 40a in the shortest distance along a direction of the tangent to a scroll. However, an orientation of the injection port 202a is not limited to the direction along the tangent at the contact point 207a as long as the orientation is directed toward the inlet port 40a. The direction toward the inlet port 40a is a direction at least tilted to a direction toward the inlet port 40a from a direction toward the central axis C1 (radial direction).

Figure 3:
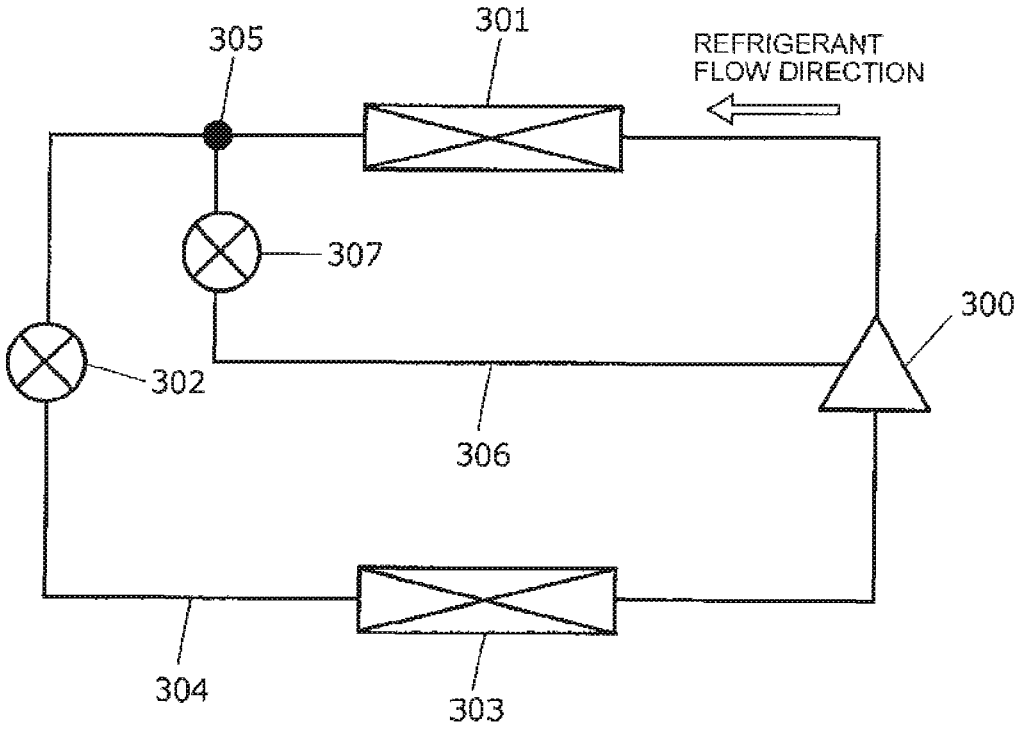
FIG. 3 is a refrigerant circuit diagram illustrating a schematic configuration of a refrigeration cycle apparatus including the scroll compressor 300 according to Embodiment 1 of the present invention.

Next, the flow of refrigerant will be described. FIG. 3 is a refrigerant circuit diagram illustrating a schematic configuration of a refrigeration cycle apparatus including the scroll compressor 300 according to the present embodiment. In FIG. 3, the flow of refrigerant is indicated by a thick arrow. As shown in FIG. 3, the refrigeration cycle apparatus includes a main circuit 304 in which the scroll compressor 300, a condenser 301, a decompressor 302 (e.g., expansion valve), and an evaporator 303 are annularly connected through refrigerant pipes. The condenser 301 is connected to the discharge pipe 102 of the scroll compressor 300 through a refrigerant pipe. The evaporator 303 is connected to the suction pipe 101 of the scroll compressor 300 through a refrigerant pipe.

Also, the refrigeration cycle apparatus includes an injection circuit 306 connecting the injection pipes 201a and 201b of the scroll compressor 300 to a bifurcation 305 provided downstream of the condenser 301 and upstream of the decompressor 302 in the main circuit 304. The injection circuit 306 is provided with a decompressor 307 (e.g., an expansion valve).

The high-temperature, high-pressure gas refrigerant compressed and discharged by the scroll compressor 300 flows into the condenser 301. In the condenser 301, heat is exchanged between the refrigerant flowing inside and an external fluid (e.g., air) and heat of condensation of the refrigerant is rejected to the external fluid. Consequently, the refrigerant flowing into the condenser 301 is condensed to become high-pressure liquid refrigerant. The liquid refrigerant passing through the condenser 301 branches at the bifurcation 305 into the main circuit 304 and the injection circuit 306. The liquid refrigerant branching off to the main circuit 304 is depressurized by the decompressor 302 to become low-pressure two-phase refrigerant. The two-phase refrigerant passing through the decompressor 302 flows into the evaporator 303. In the evaporator 303, heat is exchanged between the refrigerant flowing inside and an external fluid (e.g., air) and the refrigerant receives heat of evaporation from the external fluid. Consequently, the two-phase refrigerant flowing into the evaporator 303 evaporates to become low-pressure gas refrigerant or high-quality (high-dryness) two-phase refrigerant. The gas refrigerant or two-phase refrigerant passing through the evaporator 303 is sucked into the scroll compressor 300 and compressed again. Hereinafter, the refrigerant flowing into the scroll compressor 300 via the evaporator 303 of the main circuit 304 may be referred to as main refrigerant.

On the other hand, the liquid refrigerant branching off to the injection circuit 306 is depressurized by the decompressor 307 to become low-pressure, low-quality two-phase refrigerant (i.e., two-phase refrigerant containing much liquid refrigerant). The two-phase refrigerant passing through the decompressor 307 bypasses the evaporator 303 and flows into the scroll compressor 300 through the injection pipes 201a and 201b. Hereinafter, low-quality two-phase refrigerant flowing into the scroll compressor 300 through the injection circuit 306 may be referred to as injection refrigerant.

Next, flow of the main refrigerant flowing into the scroll compressor 300 will be described. The main refrigerant (low-pressure gas refrigerant) flowing into the first space 70 through the suction pipe 101 flows into the second space 71 through the communicating paths 7c and 7d. The gas refrigerant flowing into the second space 71 is sucked into the compression chamber through the inlet ports 40a and 40b through relative oscillatory motion of the first scroll body 1b and the second scroll body 2b. The gas refrigerant sucked into the compression chamber is pressurized from low pressure to high pressure through geometric volume changes of the compression chamber. The pressurized gas refrigerant pushes up the discharge valve 11 and is discharged outside from the discharge pipe 102 via the third space 72.

Next, flow of the injection refrigerant flowing into the scroll compressor 300 will be described. The injection refrigerant (low-quality two-phase refrigerant) flowing in through the injection pipes 201a and 201b flows into the second space 71 through each of the injection ports 202a and 202b. At this time, from the injection port 202a, the injection refrigerant is ejected toward the contact point 207a along the direction of the tangent to the scroll. The injection refrigerant ejected from the injection port 202a is injected into the inlet port 40a. Also, from the injection port 202b, the injection refrigerant is ejected toward the contact point 207b along the direction of the tangent to the scroll. The injection refrigerant ejected from the injection port 202b is injected into the inlet port 40b.

Figure 4:
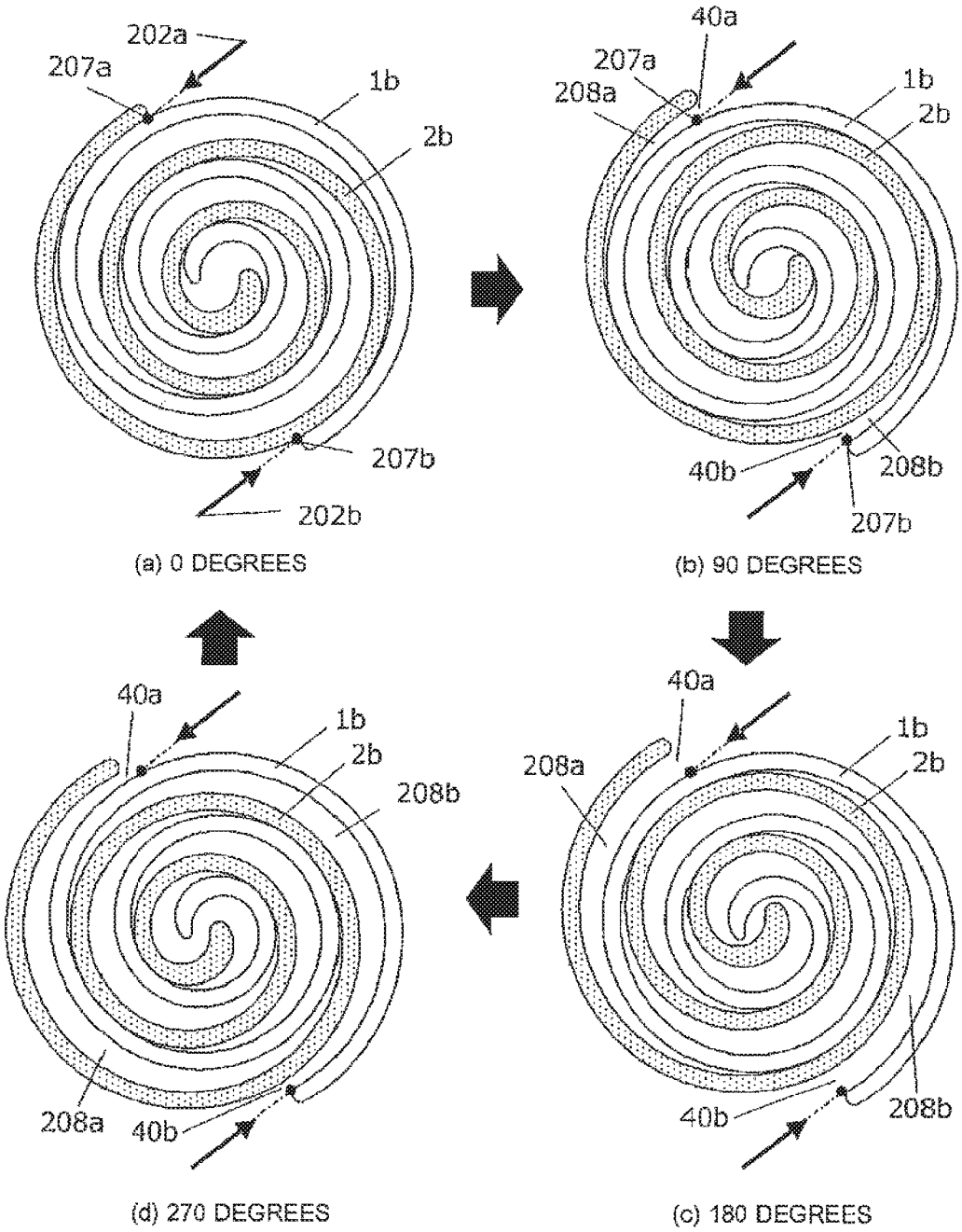
FIGS. 4 (*a*) to 4 (*d*) are diagrams illustrating relative oscillatory motion of a first scroll body 1*b* and a second scroll body 2*b* for one cycle in a section shown in FIG. 2.

FIGS. 4 (*a*) to 4 (*d*) are diagrams illustrating relative oscillatory motion of the first scroll body 1b and the second scroll body 2*b* for one cycle in a section shown in FIG. 2. FIGS. 4 (*a*) to 4 (*d*) show states in rotation phases of 0 degrees, 90 degrees, 180 degrees, and 270 degrees. The rotation phase at a time point when the fluid starts to be sucked into the compression chamber is assumed to be 0 degrees. In FIGS. 4 (*a*) to 4 (*d*), ejection directions of the injection refrigerant from the injection ports 202*a* and 202*b* are indicated by arrows.

As shown in FIGS. 4 (*a*) to 4 (*d*), with increases in the rotation phase from 0 degrees, two suction chambers 208*a* and 208*b* are formed on outermost peripheries of the first scroll body 1*b* and the second scroll body 2*b*. Volumes of the suction chambers 208*a* and 208*b* gradually increase along substantial directions of tangents to the first scroll body 1*b* and the second scroll body 2*b*. With increases in the volumes of the suction chambers 208*a* and 208*b*, the main refrigerant flows into the suction chambers 208*a* and 208*b* through the inlet ports 40*a* and 40*b* along substantial directions of tangents at the contact points 207*a* and 207*b*. Also, the injection refrigerant flows into the suction chambers 208*a* and 208*b* through the inlet ports 40*a* and 40*b* along the substantial directions of the tangents at the contact points 207*a* and 207*b*.

At this time, inflow directions of the main refrigerant into the suction chambers 208*a* and 208*b* are the substantially same as the ejection directions of the injection refrigerant from the injection ports 202*a* and 202*b* to the contact points 207*a* and 207*b*. Consequently, the injection refrigerant ejected from the injection ports 202*a* and 202*b* easily flows into the suction chambers 208*a* and 206*b* and the injection refrigerant flowing back to the first space 70 through the communicating paths 7*c* and 7*d* is reduced. The refrigerating machine oil accumulated in the oil sump 15 is less likely to be diluted by the injection refrigerant accordingly. Decreases in viscosity of the refrigerating machine oil can therefore be reduced to improve reliability of the scroll compressor 300.

Also, in the second space 71, the main refrigerant moving from the open ends 7*c*1 and 7*d*1 of the communicating paths 7*c* and 7*d* to the inlet ports 40*a* and 40*b* and the injection refrigerant moving from the injection ports 202*a* and 202*b* to the inlet ports 40*a* and 40*b* both flow in the counter-helical involute direction. Consequently, a swirling flow is formed in the second space 71 to rectify the flow of refrigerant. Pressure loss of the refrigerant can be reduced accordingly to thereby improve performance of and energy efficiency of the scroll compressor 300.

Furthermore, in the swirling flow formed in the second space 71, the open end 7*c*1 is provided on an upstream side of the injection port 202*a*, and the open end 7*d*1 is provided on an upstream side of the injection port 202*b*. Consequently, the injection refrigerant flowing back to the first space 70 through the communicating paths 7*c* and 7*d* can be more reliably reduced. Decreases in the viscosity of the refrigerating machine oil can therefore be more reliably reduced to further improve the reliability of the scroll compressor 300.

Embodiment 2

Figure 5:
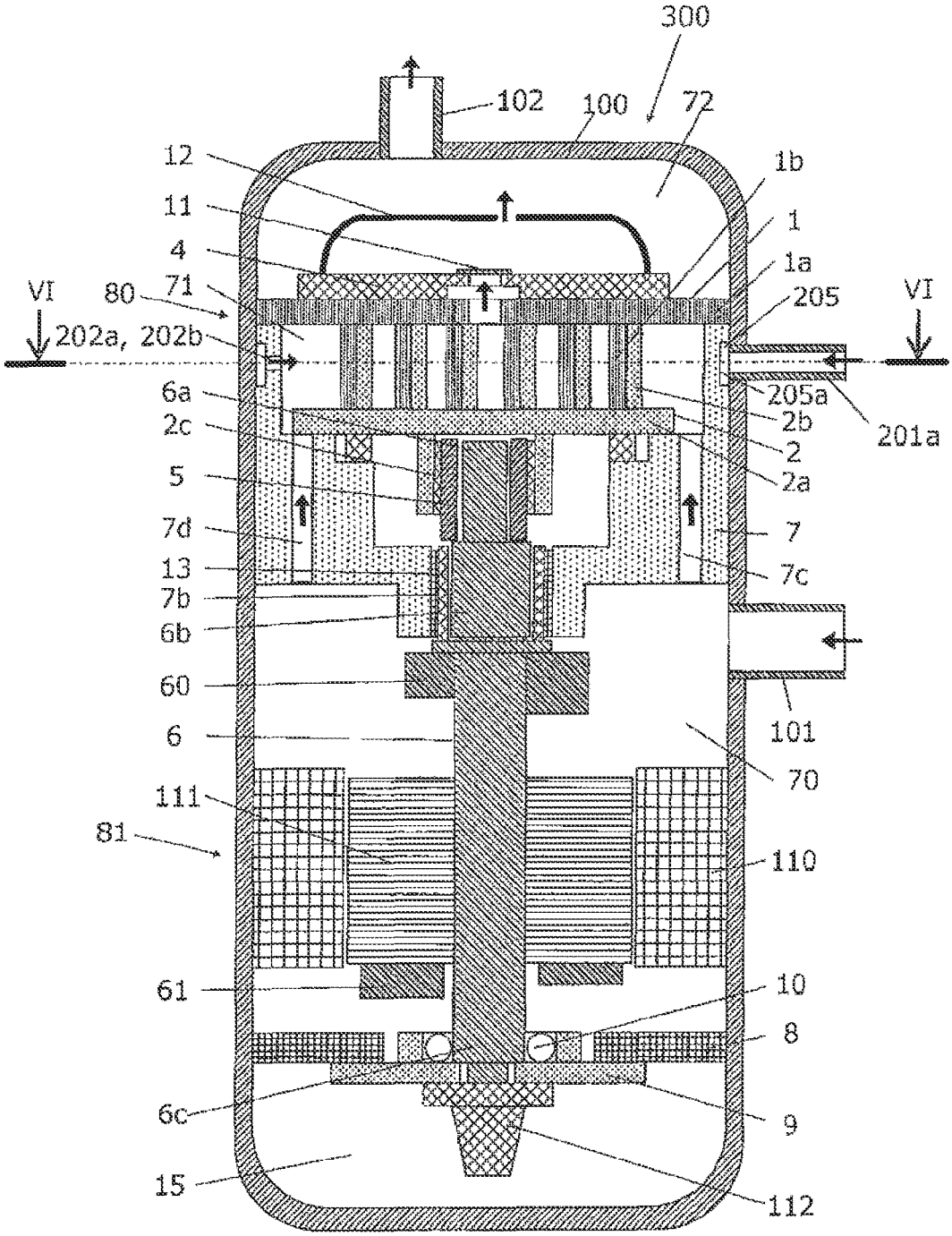
FIG. 5 is a longitudinal section view illustrating a schematic configuration of a scroll compressor 300 according to Embodiment 2 of the present invention.
Figure 6:
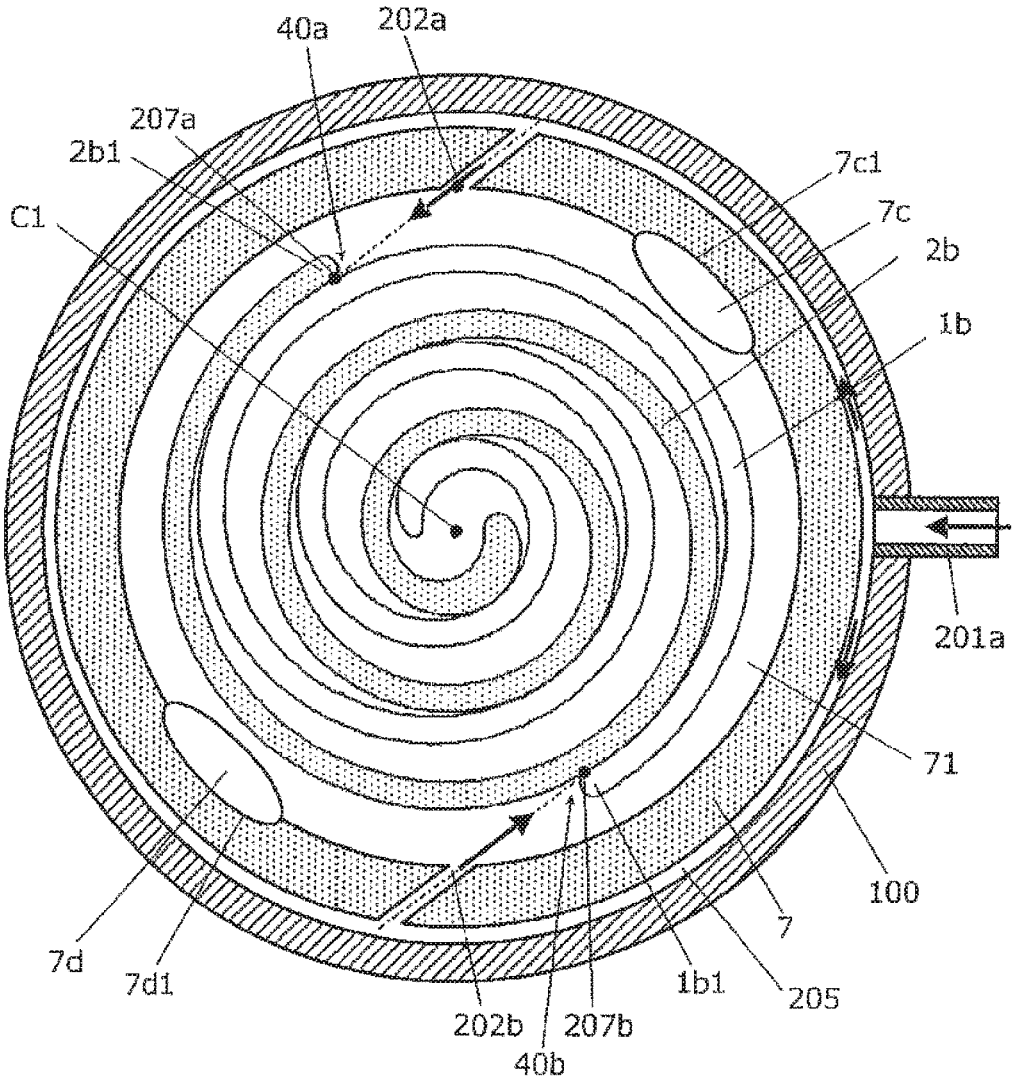
FIG. 6 is a sectional view taken along line VI-VI in FIG. 5.

A scroll compressor according to Embodiment 2 of the present invention will be described. FIG. 5 is a longitudinal section view illustrating the schematic configuration of the scroll compressor 300 according to the present embodiment. FIG. 6 is a sectional view taken along line VI-VI in FIG. 5. Note that components with the same functions and operations as those of Embodiment 1 are denoted by the same reference signs, and the description of the components will be omitted.

As shown in FIGS. 5 and 6, a refrigerant flow path 205 having, for example, an annular shape and configured to allow passage of low-quality two-phase refrigerant is provided on an outer circumferential side of the second space 71. The refrigerant flow path 205 is communicated with a plurality of the injection ports 202*a* and 202*b*. The refrigerant flow path 205 is formed in a groove 205*a* (space surrounded by the groove 205*a* and the sealed container 100, in this example) provided in an outer circumferential surface of the frame 7 to extend in the circumferential direction. The refrigerant flow path 205 is connected with one injection pipe 201*a*.

The injection refrigerant flowing in through the injection pipe 201*a* passes through the refrigerant flow path 205 and is ejected into the second space 71 through the two injection ports 202*a* and 202*b*. According to the present embodiment, the number of injection pipes 201*a* can be smaller than the number of injection ports 202*a* and 202*b*, and can be, for example, only one. Thus, effects similar to those of Embodiment 1 can be achieved using a simpler structure.

Note that, although the refrigerant flow path 205 is formed in the groove 205*a* in the frame 7 according to the present embodiment, the refrigerant flow path 205 may be formed in a groove or a recess provided in the inner circumferential surface of the sealed container 100.

Embodiment 3

Figure 7:
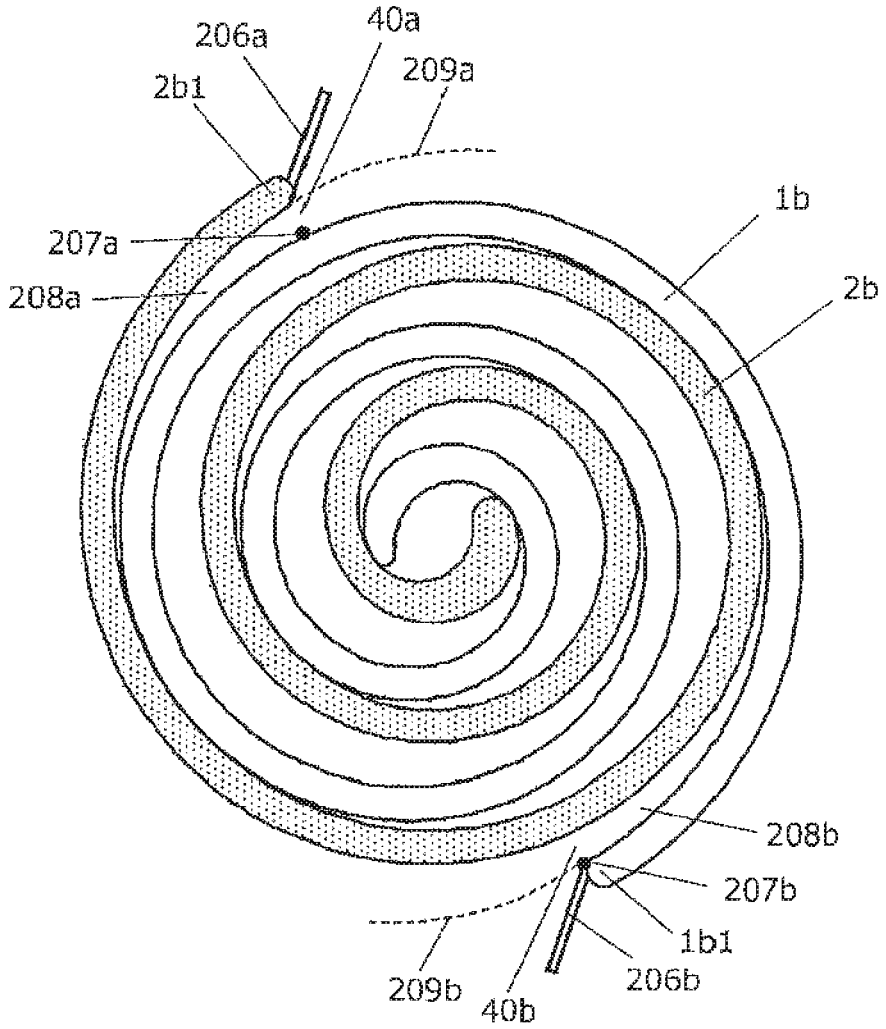
FIG. 7 is a sectional view illustrating configurations of a first scroll body 1*b* and a second scroll body 2*b* of a scroll compressor 300 according to Embodiment 3 of the present invention.

A scroll compressor according to Embodiment 3 of the present invention will be described. FIG. 7 is a sectional view illustrating configurations of a first scroll body 1*b* and the second scroll body 2*b* of the scroll compressor 300 according to the present embodiment. Note that components with the same functions and operations as those of Embodiment 1 are denoted by the same reference signs, and the description of the components will be omitted.

As shown in FIG. 7, according to the present embodiment, flow guides 206*b* and 206*a* are provided on at least one of the scroll end portion 1*b* of the first scroll body 1*b* and the scroll end portion 2*b*1 of the second scroll body 2*b* (both, in this example). The flow guides 206*a* and 206*b* each have, for example, a tabular shape.

The flow guide 206*a* formed on the scroll end portion 2*b*1 guides the liquid refrigerant ejected from the injection port 202*a* to the suction chamber 208*a* through the inlet port 40*a*. The flow guide 206*a* is inclined to an imaginary spiral line 209*a* formed by further extending the scroll from the scroll end portion 2*b*1. The flow guide 206*a* is formed to extend outward of the imaginary spiral line 209*a* from the scroll end portion 2*b*1 toward the inner wall surface of the frame 7 (outer circumference of the second space 71). Depending on an orbiting angle of the second scroll body 2*b*, the flow guide 206*a* may extend to a position at which the flow guide 206*a* touches the inner wall surface of the frame 7. Also, a height of the flow guide 206*a* in a direction orthogonal to the plane of the paper in FIG. 7 may be either equal to or lower than a height of the second scroll body 2*b*. Consequently, the second space 71 is partitioned completely or incompletely into a forward-side space extending in the shortest distance from the scroll end portion 2*b*1 to the injection port 202*a* and a space on an opposite side.

Similarly, the flow guide 206*b* formed on the scroll end portion 1*b*1 guides the liquid refrigerant ejected from the injection port 202*b* to the suction chamber 208*b* through the inlet port 40*b*. The flow guide 206*b* is inclined to an imaginary spiral line 209*b* formed by further extending the scroll from the scroll end portion 1*b*1 and is formed to extend outward of the imaginary spiral line 209*b* from the scroll end portion 1*b*1 toward the inner wall surface of the frame 7. The flow guide 206*b*, which is formed on the first scroll body 1*b* that is fixed, may extend to a position at which the flow guide 206*b* touches the inner wall surface of the frame 7. Also, a height of the flow guide 206*b* may be either equal to or lower than a height of the first scroll body 1*b*. Consequently, the second space 71 is partitioned completely or incompletely into a forward-side space extending in the shortest distance from the scroll end portion 1*b*1 to the injection port 202*b* and a space on an opposite side.

A part of the refrigerant spreading after the refrigerant is ejected from the injection ports 202*a* and 202*b* collides with the flow guides 206*a* and 206*b* and is bendingly directed toward the suction chambers 208*a* and 208*b* through the inlet ports 40*a* and 40*b*. Consequently, the injection refrigerant from the injection ports 202*a* and 202*b* is easy to be introduced into the suction chambers 208*a* and 208*b*, and thus loss of the injection refrigerant can be reduced. Consequently, the present embodiment, which can cause the injection refrigerant to flow into the suction chambers 208*a* and 208*b* more efficiently than Embodiment 1, can further reduce the Injection refrigerant flowing back to the first space 70. Thus, the reliability of the scroll compressor 300 is further improved.

Embodiment 4

Figure 8:
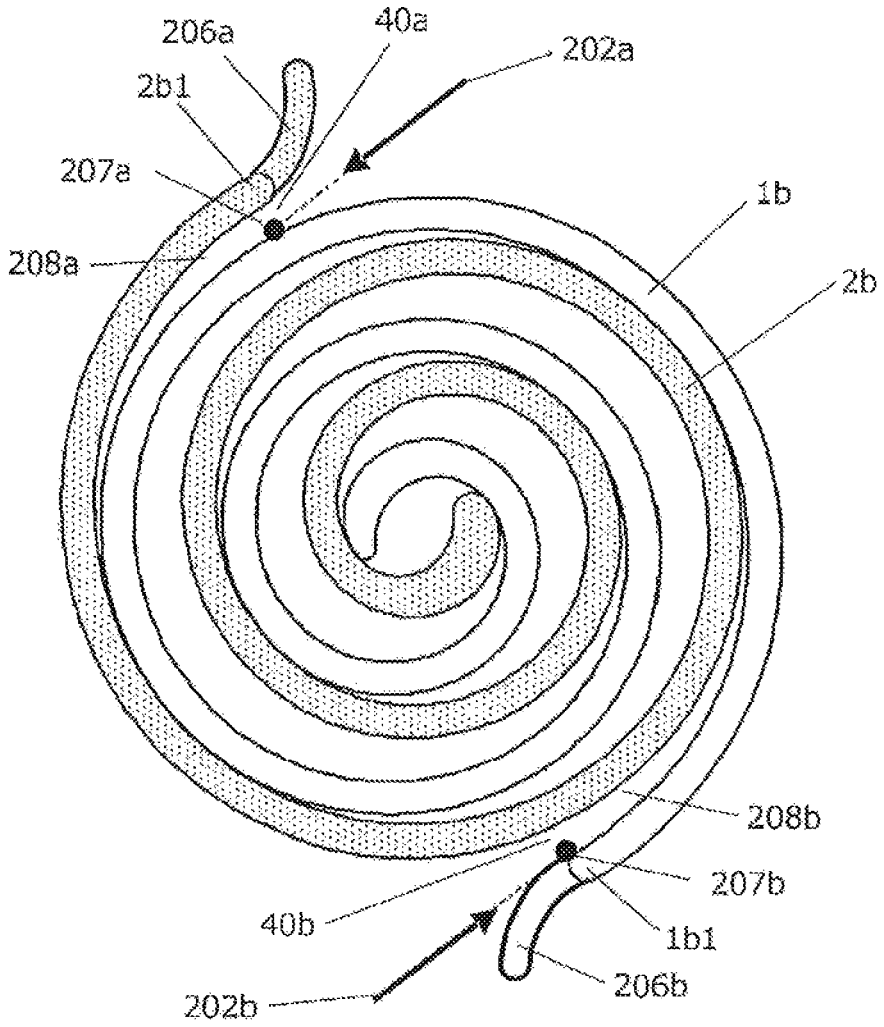
FIG. 8 is a sectional view illustrating configurations of a first scroll body 1*b* and a second scroll body 2*b* of a scroll compressor 300 according to Embodiment 4 of the present invention.

A scroll compressor according to Embodiment 4 of the present invention will be described. FIG. 8 is a sectional view illustrating configurations of the first scroll body 1*b* and the second scroll body 2*b* of the scroll compressor 300 according to the present embodiment. Note that components with the same functions and operations as those of Embodiment 1 are denoted by the same reference signs, and the description of the components will be omitted.

As shown in FIG. 8, according to the present embodiment, the flow guides 206*a* and 206*b* are formed integrally with the second scroll body 2*b* and the first scroll body 1*b*, respectively. The present embodiment is similar to Embodiment 3 in that the flow guides 206*a* and 206*b* extend from the scroll end portions 2*b*1 and 1*b* outward of the imaginary spiral lines 209*a* and 209*b* (not shown in FIG. 8), respectively, and toward the outer circumference.

The flow guide 206*a* installed on the second scroll body 2*b* has a shape extending and curving toward the outer circumferential side from the scroll end portion 2*b*1. Both side faces of the flow guide 206*a* are connected continuously and smoothly to both side faces of the second scroll body 2*b*. The side faces of the flow guide 206*a* curve in a direction opposite to a direction in which the side faces of the second scroll body 2*b* curve. The side faces of the flow guide 206*a* curve further toward the outer circumferential side as a distance from the scroll end portion 2*b*1 increases. That is, in this configuration integrating the second scroll body 2*b* and the flow guide 206*a*, an inflection point is located in the vicinity of the scroll end portion 2*b*1.

Similarly, the flow guide 206*b* installed on the first scroll body 1*b* has a shape extending and curving toward the outer circumferential side from the scroll end portion 1*b*1. Both side faces of the flow guide 206*b* are connected continuously and smoothly to both side faces of the first scroll body 1*b*. The side faces of the flow guide 206*b* curve in a direction opposite to a direction in which the side faces of the first scroll body 1*b* curve. The side faces of the flow guide 206*b* curve further toward the outer circumferential side as a distance from the scroll end portion 1*b*1 increases. That is, in this configuration integrating the first scroll body 1*b* and the flow guide 206*b*, an inflection point is located in the vicinity of the scroll end portion 1*b*1.

According to the present embodiment, a part of the refrigerant spreading after the refrigerant is ejected from the injection ports 202*a* and 202*b* can be introduced to the suction chambers 208*a* and 208*b* more smoothly than in Embodiment 3. Consequently, loss during introduction of the injection refrigerant can be further reduced.

Embodiment 5

Figure 9:
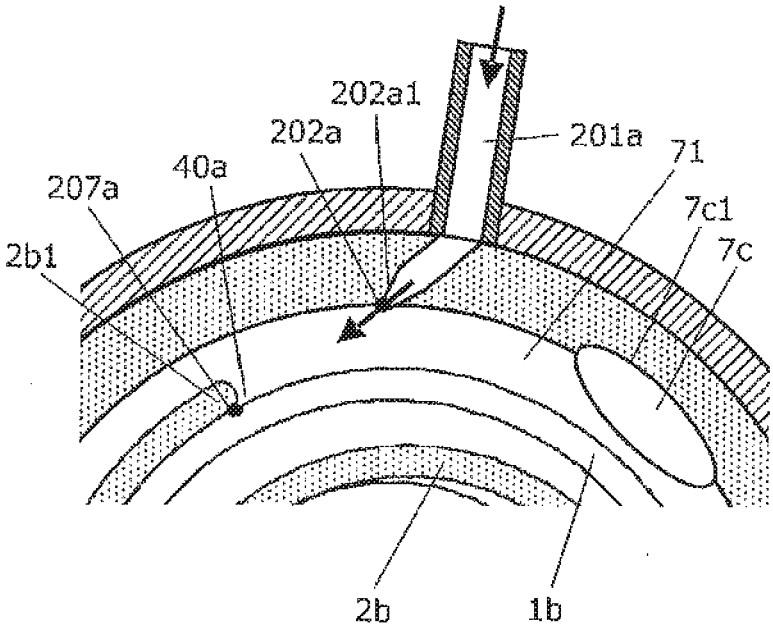
FIG. 9 is a sectional view illustrating a configuration of an injection port 202*a* and its vicinity in a scroll compressor 300 according to Embodiment 5 of the present invention.

A scroll compressor according to Embodiment 5 of the present invention will be described. FIG. 9 is a sectional view illustrating a configuration of an injection port 202*a* and its vicinity in the scroll compressor 300 according to the present embodiment. Note that components with the same functions and operations as those of Embodiment 1 are denoted by the same reference signs, and the description of the components will be omitted.

As shown in FIG. 9, according to the present embodiment, a tip 202*a*1 of the injection port 202*a* is nozzle-shaped. That is, a flow path cross-sectional area of the injection port 202*a* decreases toward the tip 202*a*1 (outlet side to the second space 71). Thus, a flow rate of the injection refrigerant flowing through the injection port 202*a* increases toward the outlet side to the second space 71. Note that, although not illustrated, the injection port 202*b* has a configuration similar to the injection port 2028.

According to the present embodiment, droplets of the injection refrigerant ejected from the injection ports 202*a* and 202*b* can be made more difficult to diffuse than in Embodiment 1. Consequently, the present embodiment, which can cause the injection refrigerant to flow efficiently into the suction chambers 208*a* and 208*b*, can further reduce the injection refrigerant flowing back to the first space 70. Thus, the reliability of the scroll compressor 300 is further improved.

As described above, the scroll compressor 300 according any of Embodiments 1 to 5 above includes the sealed container 100, the motor element 81 housed in the sealed container 100, the scroll compression element 80 housed in the sealed container 100 and configured to be driven by the rotating shaft portion 6 of the motor element 81, and the frame 7 placed between the motor element 81 and the scroll compression element 80 in the sealed container 100 and configured to support the scroll compression element 80. The scroll compression element 80 includes the fixed scroll 1 fixed to the frame 7 and including the first scroll body 1*b* and the orbiting scroll 2 including the second scroll body 2*b* configured to be engaged with the first scroll body 1*b* to form a compression chamber between the first scroll body 1*b* and the second scroll body 2*b* and orbit opposed to the fixed scroll 1. The first space 70 into which gas refrigerant sucked from outside flows is provided in the sealed container 100 on the side of the motor element 81 of the frame 7. The second space 71 communicated with the first space 70 through the communicating paths 7*c* and 7*d* is provided on an outer circumferential side of the first scroll body 1*b* and the second scroll body 2*b*. The scroll end portion 1*b*1 of the first scroll body 1*b* and the scroll end portion 2*b*1 of the second scroll body 2*b* are configured to form the inlet port 40*a* and the inlet port 40*b*, respectively, configured to suck the gas refrigerant into the compression chamber from the second space 71. The open ends 7*c*1 and 7*d*1 of the communicating paths 7*c* and 7*d* on the side of the second space 71 are located at an angle θ1 larger than 0 degrees and less than or equal to 180 degrees, around the central axis C1 of the rotating shaft portion 6, from the inlet ports 40*a* and 40*b* in the scroll involute direction of the first scroll body 1*b* and the second scroll body 2*b*. The injection ports 202*a* and 202*b* are provided in a part of the outer circumference of the second space 71 between the open ends 7*c*1 and 7*d*1 and the inlet ports 40*a* and 40*b* in the circumferential direction and configured to eject the liquid refrigerant in a direction toward the inlet ports 40*a* and 40*b*.

In this configuration, the open ends 7*c*1 and 7*d*1 of the communicating paths 7*c* and 7*d* are located at an angle θ1 larger than 0 degrees and less than or equal to 180 degrees from the inlet ports 40*a* and 40*b* in the scroll involute direction of the first scroll body 1*b* and the second scroll body 2*b* around the central axis C1. Consequently, the main refrigerant in the second space 71 is likely to flow in a single direction of the counter-helical involute direction from the open ends 7*c*1 and 7*d*1 to the inlet ports 40*a* and 40*b*, respectively. The injection ports 202*a* and 202*b* are provided on a route from the open ends 7*c*1 and 7*d*1 of the communicating paths 7*c* and 7*d* to the inlet ports 40*a* and 40*b*, respectively. Consequently, the liquid refrigerant ejected from the injection ports 202*a* and 202*b* when the inlet ports 40*a* and 40*b* are closed remains in the second space 71, and is sucked into the compression chamber when the inlet ports 40*a* and 40*b* are open the next time. That is, in the second space 71, the refrigerant flows in a single direction of the counter-helical involute direction, and thus the liquid refrigerant that does not flow into the inlet ports 40*a* and 40*b* is not likely to flow into the open ends 7*c*1 and 7*d*1 located in a direction (helical involute direction) opposite to the inlet ports 40*a* and 40*b*. Consequently, the liquid refrigerant flowing back to the first space 70 through the communicating paths 7*c* and 7*d* can be reduced.

While operation is performed under a wet suction condition in the compression chamber, almost no liquid refrigerant or two-phase refrigerant flows into the first space 70 accordingly, and thus operation can be performed under a dry condition in the first space 70. Consequently, the refrigerating machine oil accumulated in the oil sump 15 can be prevented from being diluted by the liquid refrigerant and the refrigerating machine oil of sufficient viscosity can be supplied to the sliding parts. Thus, the discharge temperature can be reduced greatly by injection of the liquid refrigerant and the reliability of the scroll compressor 300 can be improved. Furthermore, the refrigerant in the second space 71 can be rectified to low in a single direction, and thus fluid loss in the second space 71 can be reduced. Thus, the performance of the scroll compressor 300 can be improved. Besides, because the liquid refrigerant is mixed with the gas refrigerant yet to be compressed, mixing loss can be reduced compared to that of a configuration in which liquid refrigerant is mixed with gas refrigerant that is being compressed.

Also, in the scroll compressor 300 according to the above embodiment, the plurality of the injection ports 202*a* and 202*b* are provided along the circumferential direction of the second space 71 and the refrigerant flow path 205 communicated with the plurality of the injection ports 202*a* and 202*b* is provided on the outer circumferential side of the second space 71. Also, in the scroll compressor 300 according to the present embodiment, the refrigerant flow path 205 is formed in the groove 205*a* provided in the outer circumferential surface of the frame 7 to extend in the circumferential direction.

With this configuration, the number of injection pipes 201*a* through which the injection refrigerant is introduced from outside can be smaller than the number of injection ports 202*a* and 202*b*, and can be, for example, only one. Thus, the above effects can be achieved using a simpler structure.

Also, in the scroll compressor 300 according to the above embodiment, on at least one of the scroll end portion 1*b*1 of the first scroll body 1*b* and the scroll end portion 2*b*1 of the second scroll body 2*b*, the flow guide 206*a* or 206*b* is formed to extend toward the outer circumference and outward of the imaginary spiral line 209*a* or 209*b* extending from the scroll end portion 2*b*1 or 1*b*1 and configured to guide the liquid refrigerant ejected from the injection port 202*a* or 202*b* to the inlet port 40*a* or 40*b*.

With this configuration, the liquid refrigerant ejected from the injection port 202*a* or 202*b* is easy to be introduced to the inlet port 40*a* or 40*b* to further reduce the liquid refrigerant flowing back to the first space 70 through the inlet ports 40*a* and 40*b*.

Also, in the scroll compressor 300 according to the above embodiment, the angle θ2 formed between the inlet port 40*a* or 40*b* and the injection port 202*a* or 202*b* around the central axis C1 is smaller than the angle θ3 formed between the injection port 202*a* or 202*b* and the open end 70*c* or 7*d*1 around the central axis C1.

With this configuration, in the second space 71, the distance between the inlet port 40*a* or 40*b* and the injection port 202*a* or 202*b* can be made shorter than the distance between the injection port 202*a* or 202*b* and the open end 7*c*1 or 7*d*1. Consequently, the liquid refrigerant flowing back to the first space 70 through the inlet ports 40*a* and 40*b* can be further reduced.

Also, in the scroll compressor 300 according to the above embodiment, the tips of the injection ports 202*a* and 202*b* (the tip 202*a*1 of the injection port 202*a* and the tip of the injection port 202*b*) are nozzle-shaped.

With this configuration, the liquid refrigerant ejected from the injection port 202*a* is difficult to diffuse to reduce an amount of liquid refrigerant leaking to the second space 71 through the inlet ports 40*a* and 40*b*.

Other Embodiments

The present invention is not limited to the embodiments described above, and various modifications are possible.

For example, although the scroll compressor 300 is described to be vertically mounted as an example in the above embodiments, the present invention is also applicable to transversely-mounted scroll compressors.

REFERENCE SIGNS LIST

1 fixed scroll 1*a* base plate 1*b* first scroll body 1*b*1 scroll end portion 2 orbiting scroll 2*a* base plate 2*b* second scroll body 2*b*1 scroll end portion 2*c* orbiting bearing 4 discharge port 5 slider 6 rotating shaft portion 6*a* eccentric shaft portion 6*b* main shaft portion 6*c* countershaft portion 7 frame 7*b* main bearing 7*c*, 7*d* communicating path 7*c*1, 7*d*1 open end 8 subframe plate 9 subframe 10 secondary bearing 11 discharge valve 12 discharge muffler 13 sleeve 15 oil sump 40*a*, 40*b* inlet port 60 first balance weight 61 second balance weight 70 first space 71 second space 72 third space 80 scroll compression element 81 motor element 100 sealed container 101 suction pipe 102 discharge pipe 110 electric motor stator 111 electric motor rotor 112 pump element 201*a*, 201*b* Injection pipe 202*a*, 202*b* injection port 202*a*1 tip 205 refrigerant flow path 205*a* groove 206*a*, 206*b* flow guide 207*a*, 207*b* contact point 208*a*, 208*b* suction chamber 209*a*, 209*b* imaginary spiral line 211 end portion 300 scroll compressor 301 condenser 302, 307 decompressor 303 evaporator 304 main circuit 305 bifurcation 306 injection circuit C1 central axis

The invention claimed is:

1. A scroll compressor comprising:

a sealed container;

a motor element housed in the sealed container;

a scroll compression element housed in the sealed container and configured to be driven by a rotating shaft portion of the motor element; and a frame placed between the motor element and the scroll compression element in the sealed container and configured to support the scroll compression element, the scroll compression element including a fixed scroll fixed to the frame and including a first scroll body and an orbiting scroll including a second scroll body configured to be engaged with the first scroll body to form a compression chamber between the first scroll body and the second scroll body, the orbiting scroll being configured to orbit opposed to the fixed scroll, a first space into which gas refrigerant sucked from outside flows being provided in the sealed container on a motor element side of the frame, a second space communicated with the first space through a communicating path being provided on an outer circumferential side of the first scroll body and the second scroll body, a scroll end portion of the first scroll body and a scroll end portion of the second scroll body being each configured to form an inlet port configured to suck the gas refrigerant into the compression chamber in a counter scroll involute direction from the second space, an open end of the communicating path on a side of the second space being located at an angle larger than 0 degrees and less than or equal to 180 degrees, around a central axis of the rotating shaft portion, from the inlet port in a scroll involute direction of the first scroll body and the second scroll body, an injection port being provided in a part of an outer circumference of the second space between the open end of the communicating path and the inlet port in a circumferential direction, the injection port being configured to eject liquid refrigerant in a direction toward the inlet port.

2. The scroll compressor of claim 1, wherein a plurality of the injection ports are provided along the circumferential direction of the second space, and a refrigerant flow path communicated with the plurality of the injection ports are provided on an outer circumferential side of the second space.

3. The scroll compressor of claim 2, wherein the refrigerant flow path is formed in a groove provided in an outer circumferential surface of the frame to extend in the circumferential direction.

4. The scroll compressor of claim 1, wherein, on at least one of the scroll end portion of the first scroll body and the scroll end portion of the second scroll body, a flow guide is formed to extend outward of an imaginary spiral line extending from the scroll end portion, the flow guide being configured to guide the liquid refrigerant ejected from the injection port to the inlet port.

5. The scroll compressor of claim 1, wherein an angle formed between the inlet port and the injection port around the central axis of the rotating shaft portion is smaller than an angle formed between the injection port and the open end around the central axis of the rotating shaft portion.

6. The scroll compressor of claim 1, wherein a tip of the injection port is nozzle-shaped.

* * * * *